US009858884B2

(12) United States Patent
Yeo et al.

(10) Patent No.: US 9,858,884 B2
(45) Date of Patent: Jan. 2, 2018

(54) SOURCE DRIVER AND DISPLAY APPARATUS INCLUDING THE SAME

(71) Applicants: Seung Jin Yeo, Seoul (KR); Sun Young Lee, Uijeongbu-si (KR); Jeong Tae Park, Yongin-si (KR)

(72) Inventors: Seung Jin Yeo, Seoul (KR); Sun Young Lee, Uijeongbu-si (KR); Jeong Tae Park, Yongin-si (KR)

(73) Assignee: Dongbu Hitek Co., Ltd., Bucheon-si (KR)

( * ) Notice: Subject to any disclaimer, the term of this patent is extended or adjusted under 35 U.S.C. 154(b) by 352 days.

(21) Appl. No.: 14/734,417

(22) Filed: Jun. 9, 2015

(65) Prior Publication Data

US 2016/0104415 A1 Apr. 14, 2016

(30) Foreign Application Priority Data

Oct. 10, 2014 (KR) ..... 10-2014-0136533

(51) Int. Cl.
*G09G 3/36* (2006.01)

(52) U.S. Cl.
CPC ... *G09G 3/3685* (2013.01); *G09G 2310/0275* (2013.01); *G09G 2310/0291* (2013.01); *G09G 2320/0223* (2013.01)

(58) Field of Classification Search
CPC ... G09G 2310/0275; G09G 2310/0291; G09G 2320/0223; G09G 3/3685
See application file for complete search history.

(56) References Cited

U.S. PATENT DOCUMENTS

| | | | | |
|---|---|---|---|---|
| 7,649,519 | B2 | 1/2010 | Seo et al. | |
| 7,671,831 | B2 | 3/2010 | Chang et al. | |
| 2006/0164375 | A1* | 7/2006 | Kim | G09G 3/3685 345/100 |
| 2007/0008009 | A1* | 1/2007 | Son | H03K 17/165 326/87 |

(Continued)

FOREIGN PATENT DOCUMENTS

| | | | |
|---|---|---|---|
| JP | 2009225457 | A | 10/2009 |
| KR | 1020070075565 | A | 7/2007 |

(Continued)

OTHER PUBLICATIONS

Korean Office Action dated Jun. 21, 2015 for the Korean Patent Application No. 10-2014-0136533; 7 pgs.; Korean Intellectual Property Office, Republic of Korea.

(Continued)

*Primary Examiner* — Latanya Bibbins
(74) *Attorney, Agent, or Firm* — Andrew D. Fortney; Central California IP Group, P.C.

(57) ABSTRACT

Disclosed is a display driver including an input pad configured to receive a supply voltage, a wiring line connected to the input pad, a digital-to-analog converter configured to output analog signals based on digital-to-analog conversion results of data, a plurality of output buffer units configured to buffer the analog signals, and a plurality of bias controllers connected to different positions of the wiring line. Each of the bias controllers independently controls a bias voltage of a corresponding one of the output buffer units based on the supply voltage supplied through the wiring line.

16 Claims, 7 Drawing Sheets

(56) References Cited

U.S. PATENT DOCUMENTS

| | | | | |
|---|---|---|---|---|
| 2007/0115271 | A1 | 5/2007 | Seo et al. | |
| 2007/0164974 | A1 | 7/2007 | Chang et al. | |
| 2008/0062373 | A1* | 3/2008 | Kim | G02F 1/1345 349/151 |
| 2008/0278473 | A1 | 11/2008 | An | |

FOREIGN PATENT DOCUMENTS

| | | | |
|---|---|---|---|
| KR | 1020070054318 | | 10/2007 |
| KR | 100861921 | B | 9/2008 |

OTHER PUBLICATIONS

Tsuchi Hiroshi; "Differential Amplifier, Data Driver for Display Device Using Same, and Control Method of Differential Amplifier"; (40 pgs.); Bibliographic Data of JP2009225457 (A); Oct. 1, 2009; http://worldwide.espacenet.com.

Seo Myung Ho et al.; "Source Driver and Display Device Having the Same, and Control Method of Differential Amplifier"; (25 pgs.); Bibliographic Data of KR10-2007-0054318; Oct. 5, 2007; http://engpat.kipris.or.kr.

Office Action dated Jan. 19, 2016 for Korean Patent Application No. 10-2014-0136533; 7 pgs; Korean Intellectual Property Office, Republic of Korea.

Chang Ho Ah; "Source Line Driver and Method for Controlling Slew Rate of Output Signal According to Temperature, and Display Device Having the Same"; Bibliographic Data of KR100861921 (B1); Oct. 9, 2008; http://worldwide.espacenet.com.

Soo Cheol Lee; "Output Buffer with Improved Output Deviation Using Transistors Having Different Driving Capacities and Source Driver for Flat Display Device Having the Same"; Abstract of Korean Publication No. 1020070075565 A; Publication Date of Jul. 24, 2007; http://kpa.kipris.or.kr.

* cited by examiner

SOURCE DRIVER AND DISPLAY APPARATUS INCLUDING THE SAME

This application claims the benefit of Korean Patent Application No. 10-2014-0136533, filed on Oct. 10, 2014, which is hereby incorporated by reference as if fully set forth herein.

BACKGROUND OF THE INVENTION

1, Field of the Invention

Embodiments of the present invention relate to a source driver of or for a liquid crystal display apparatus.

2, Discussion of the Related Art

A display apparatus may include a display panel, a source driver to drive a data line of the display panel, a gate driver to drive a gate line of the display panel, and a control unit to provide the source driver with a voltage and one or more control signals.

The control unit may include a circuit board, a power supply unit mounted on the circuit board, and a timing controller. The power supply unit may supply a voltage to the source driver, and the control unit may supply a control signal to control the source driver.

The gate driver and the source driver may be electrically connected to the display panel via mounting technologies such as, for example, Surface Mount Technology (SMT), Chip On Board (COB), Chip On Glass (COG), or Chip On Film (COF).

For example, the gate driver and the source driver may be directly mounted on a liquid crystal panel and electrically connected to the liquid crystal panel via a wire formed on a glass substrate(e.g., of the display panel).

In addition, the circuit board of the control unit and the wire on the liquid crystal panel may be electrically connected to each other via a flexible circuit board.

The power supply unit may supply an output (e.g., a supply voltage) to the source driver through a wire on the circuit board, a wire on the flexible circuit board, and the wire on the liquid crystal panel. However, resistances of the respective wires may reduce the supply voltage to the source driver, which may increase the slew rate of the source driver.

In particular, the wire on the liquid crystal panel (made from, for example, an Indium Tin Oxide [ITO] layer) has a relatively high resistance, and demands for minimizing the wire width (e.g., due to a narrow bezel) increases the resistance of power supply wires.

A driver integrated circuit (D-IC) may provide 1284 channel outputs and include a bias circuit for DC biasing of an output buffer. In the bias circuit, the output current of a reference current circuit, which is unaffected by the supply voltage and temperature variations, is mirrored to a main bias and re-mirrored to local bias branches of left and right channels.

A power supply of the D-IC includes serially combined resistances of the ITO wire on glass, a PAD, and an IC inner wire. A power supply of the output buffer faces a greater resistance with increasing distance from an input of the IC power supply.

While the D-IC is operating, the power supply of the output buffer may undergo a voltage (e.g., IR) drop due to use of driving current and the resistance of the power supply wire. The IR drop of a supply voltage reaches a maximum value when the wire resistance is at the maximum value. Under this condition, the output of a local bias circuit configured to hold operating current of the output buffer may be short-circuited to a common level regardless of a position of the local bias in the D-IC. As a result, the output of the local bias circuit is averaged and applied to the output buffer.

Output buffers of 1284 channels, which receive a common bias voltage level, operate in different respective supply voltage states according to positions thereof in the IC, due to IR drop caused by the wire resistance.

With the above-described mechanism, the $|V_G-V_S|$ voltage of an output buffer tail bias transistor differs between the respective channels, causing deviation in the amount of tail current. Consequently, this causes deviation in the slew rate of the 1284 outputs during output signal transitions.

The slew rate deviation generated as described above causes a deviation in the pixel voltage charge/discharge times, which may result in deterioration in resolution while driving signals in a high-speed TFT-LCD panel.

SUMMARY OF THE INVENTION

Accordingly, embodiments of the invention are directed to a display driver (e.g., a source driver) and a display apparatus including the same that substantially obviate one or more problems due to limitations and disadvantages of the related art.

An object of various embodiments of the invention is to provide a display driver (e.g., a source driver which is capable of reducing deviations in the slew rate of outputs from output buffers, and a display apparatus including the display driver.

Additional advantages, objects, and features of various embodiments will be set forth in part in the description which follows and in part will become apparent to those having ordinary skill in the art upon examination of the following or may be learned from practice of the embodiments. The objectives and other advantages of the embodiments may be realized and attained by the structures particularly pointed out in the written description and claims hereof as well as the appended drawings.

To achieve these objects and other advantages and in accordance with the purpose(s) of various embodiments, as embodied and broadly described herein, in one embodiment, a display driver includes an input pad configured to receive a supply voltage, a wiring line connected to the input pad and configured to supply the supply voltage, the wiring line having a plurality of different positions or locations, a digital-to-analog converter configured to output analog signals based on received digital signals (e.g., configured to convert digital data to analog data), a plurality of output buffer units configured to receive a bias voltage and buffer the analog signals, and a plurality of bias controllers connected to the different positions or locations of the wiring line, wherein each of the bias controllers independently controls a bias voltage of one or more of the output buffer units from the supply voltage supplied by the wiring line.

A first one of the output buffer units and the wiring line may be connected to each other at a first node that is adjacent to a second node where a first one of the bias controllers (e.g., corresponding to the first output buffer unit) and the first wiring line are connected to each other.

Each of the output buffer units may include a plurality of output buffers connected to the wiring line (e.g., at different nodes or positions thereof).

Each of the bias controllers may control the bias voltage to each of the output buffers in a corresponding one of the output buffer units (e.g., so that the output buffers receive the bias voltage from a corresponding one of the first nodes).

Each of the output buffer units may further include a plurality of bias transistors, and each of the bias transistors may include a source and a drain connected between one (or more) of the output buffers and the wiring line and a gate configured to be controlled by a corresponding one of the bias controllers (e.g., configured to receive the bias voltage from the corresponding bias controller).

The bias controllers may provide the supply voltage as a bias voltage from the nodes at which the output buffers in a corresponding output buffer unit and the wiring line are connected.

Each of the bias controllers may include a first transistor including a first source connected to the wiring line, a first gate connected to the gates of the bias transistors in a corresponding output buffer unit, and a first drain connected to the first gate.

Each of the bias controllers may further include a reference current supply unit connected to the drain of the first transistor. The reference current supply unit may be configured to direct a reference current to the first transistor.

Each of the bias transistors and the first transistor may form a current mirror.

A wiring distance of each of the bias controllers from the input pad may be shorter than a wiring distance of a corresponding one of the output buffer units from the input pad.

The wiring distance of each of the bias controllers from the input pad may be longer than a wiring distance of a corresponding one of the output buffer units from the input pad.

A first node where each of the bias controllers and the wiring line are connected may be located between second nodes where the output buffers in a corresponding one of the output buffer units and the wiring line are connected.

The second nodes may be symmetrical with respect to the first node.

The display driver may further include a latch unit configured to store data (e.g., to be received and output by one or more of the output buffer units), and a level shifter configured to convert a voltage level of the data from the latch unit and provide the voltage level-converted data to the digital-to-analog converter.

In accordance with another embodiment, the display driver includes a first input pad configured to receive a first supply voltage, a second input pad configured to receive a second supply voltage, a first wiring line connected to the first input pad, a second wiring line connected to the second input pad, a digital-to-analog converter configured to output analog signals from digital data, a plurality of output buffer units configured to buffer the analog signals, and a plurality of bias controllers connected between the first wiring line and the second wiring line, wherein each of the output buffer units includes a plurality of output buffers, and each of the bias controllers independently controls bias voltages to the output buffers in one or more of the output buffer units.

Each of the output buffers may be connected to one of a plurality of first nodes at different positions or locations of the first wiring line and one of a plurality of second nodes at different positions or locations of the second wiring line.

Each of the bias controllers may provide a first bias voltage and a second bias voltage to each of the output buffers in one of the output buffer units from a corresponding one of the first nodes and a corresponding one of the second nodes, respectively.

Each of the output buffer units may include first bias transistors connected between the output buffers and the first nodes, and second bias transistors connected between the output buffers and the second nodes.

Each of the bias controllers may include a first transistor including a first source connected to the first wiring line, a first gate connected to gates of the first bias transistors, and a first drain connected to the first gate, and a second transistor including a second source connected to the second wiring line, a second gate connected to gates of the second bias transistors, and a second drain connected to the second gate.

In a further embodiment, a display apparatus includes a display panel including gate lines in rows, data lines in columns, a pixel array connected to the gate lines and the data lines, and display drivers according to any one of the embodiments described herein, configured to drive one of the gate lines and the data lines. In some embodiments, each of the display drivers is a source driver.

It is to be understood that both the foregoing general description and the following detailed description of the embodiments are exemplary and explanatory and are intended to provide further explanation of the invention as claimed.

BRIEF DESCRIPTION OF THE DRAWINGS

The accompanying drawings, which are included to provide a further understanding of the embodiments and are incorporated in and constitute a part of this application, illustrate embodiment(s) of the embodiments and together with the description serve to explain the principle of the embodiments. In the drawings.

DETAILED DESCRIPTION OF THE INVENTION

Figure 1:
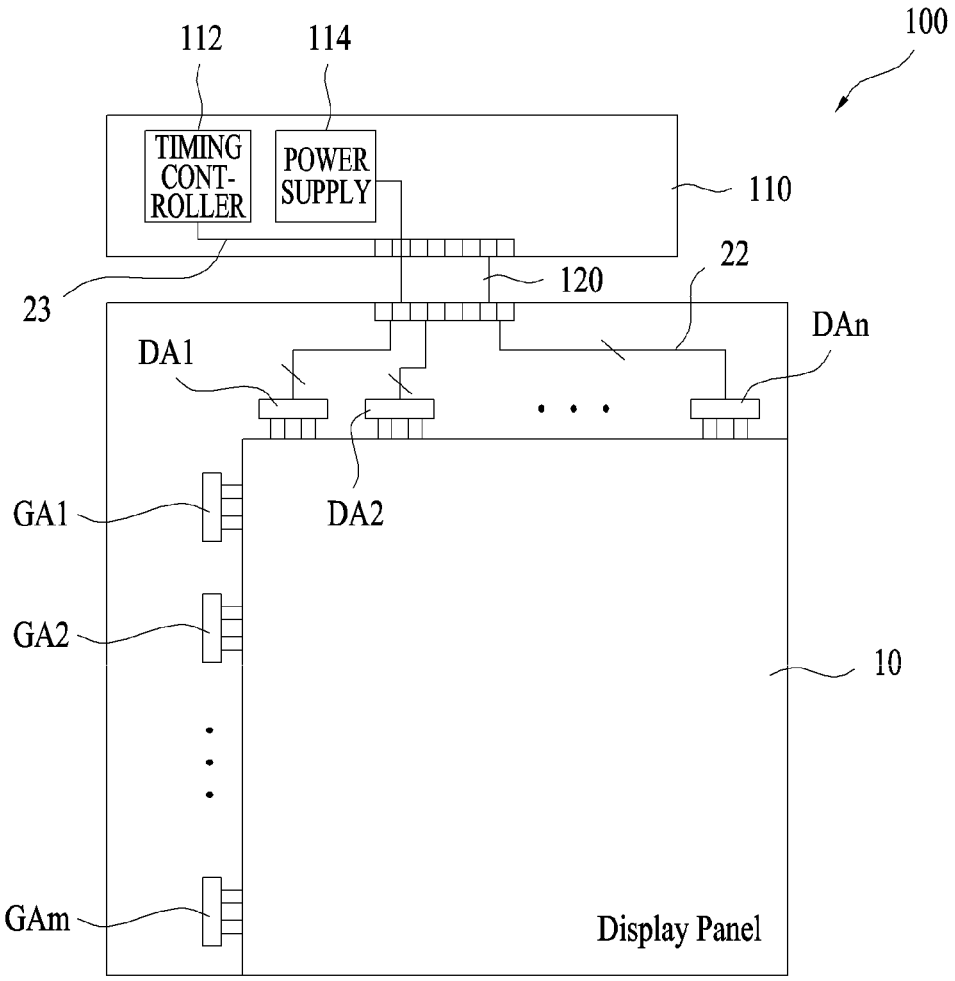
FIG. 1 is a view illustrating an exemplary configuration of a display apparatus according to one or more embodiments of the invention.

Hereinafter, the embodiments will be clearly appreciated through the accompanying drawings and the following description thereof. In the description of the embodiments, it will be understood that, when an element such as a layer (film), region, pattern or structure is referred to as being formed "on" or "under" another element, such as a substrate, layer (film), region, pad or pattern, it can be directly "on" or "under" the other element or be indirectly formed with intervening elements therebetween. It will also be understood that "on" or "under" the element may be described relative to the drawings.

In the drawings, the size of each layer may be exaggerated, omitted or schematically illustrated for clarity and convenience. In addition, the size of each constituent element does not wholly reflect an actual size thereof. In addition, the same reference numerals designate the same constituent elements throughout the description of the drawings.

FIG. 1 is a view illustrating an exemplary configuration of a display apparatus 100 according to one or more embodiments of the invention.

Referring to FIG. 1, the display apparatus 100 includes a display panel 20, gate drivers GA1 to GAm (m being a natural number greater than 1), source drivers DA1 to DAn (n being a natural number greater than 1), a timing controller 112, a power supply 114, a printed circuit board 110, and a connection board 120.

The display panel 20 may take the form of a matrix in which gate lines in rows and data lines in columns intersect, and includes a pixel array 10 including a plurality of individual pixels connected to respective intersecting gate lines and data lines. Each pixel in the pixel array 10 may include a thin film transistor and a capacitor. For example, the display panel 20 may be a liquid crystal display panel.

The gate drivers GA1 to GAm (m being a natural number greater than 1) drive the gate lines of the display panel 20 in response to first control signals from the timing controller 112. The thin film transistors of the pixel array 10, connected to the gate lines driven by the gate drivers, may be driven on a per gate line basis.

The source drivers DA1 to DAn (n being a natural number greater than 1) provide the data lines of the display panel 20 with pixel data from the timing controller 112 in response to second control signals from the timing controller 112.

The gate drivers GA1 to GAm (m being a natural number greater than 1) and the source drivers DA1 to DAn (n being a natural number greater than 1) may be mounted on the liquid crystal panel 20 by a Chip On Glass (COG) mounting method.

In addition, first wiring lines 22 electrically connected to the source drivers DA1 to DAn (n being a natural number greater than 1) and second wiring lines (not illustrated) electrically connected to the gate drivers GA1 to GAm (m being a natural number greater than 1) may be formed on the liquid crystal panel 20.

The first wiring lines 22 and the second wiring lines may be formed on the liquid crystal panel 20 by a line-on-glass technique. For example, the first wiring lines and the second wiring lines may comprise a transparent conductive oxide, such as Indium Tin Oxide (ITO).

The timing controller 112 and the power supply 114 are mounted on the printed circuit board 110. The printed circuit board 110 may include third wiring lines 23 electrically connected to the timing controller 112 and the power supply 114.

The timing controller 112 outputs the first control signals, the second control signals, and the pixel data (e.g., luminance and/or chrominance data for red [R], green [G], and blue [B] pixels).

For example, the first control signals may include a gate start pulse, a gate shift clock or timing signal, and a gate enable signal. The second control signals may include a clock or timing signal, a horizontal start signal, an enable signal, and a polarity signal POL.

The power supply 114 generates drive voltages to drive the gate drivers GA1 to GAm (m being a natural number greater than 1) and the source drivers DA1 to DAn (n being a natural number greater than 1). For example, the drive voltages may include a gate high voltage, a gate low voltage, a common voltage VCOM, a ground voltage, and a supply voltage VCC.

The connection board 120 electrically connects the first wiring lines 22 and the second wiring lines on the liquid crystal panel 20 and the third wiring lines 23 of the printed circuit board 110 to each other. For example, the connection board 120 may be a flexible printed circuit board.

Figure 2:
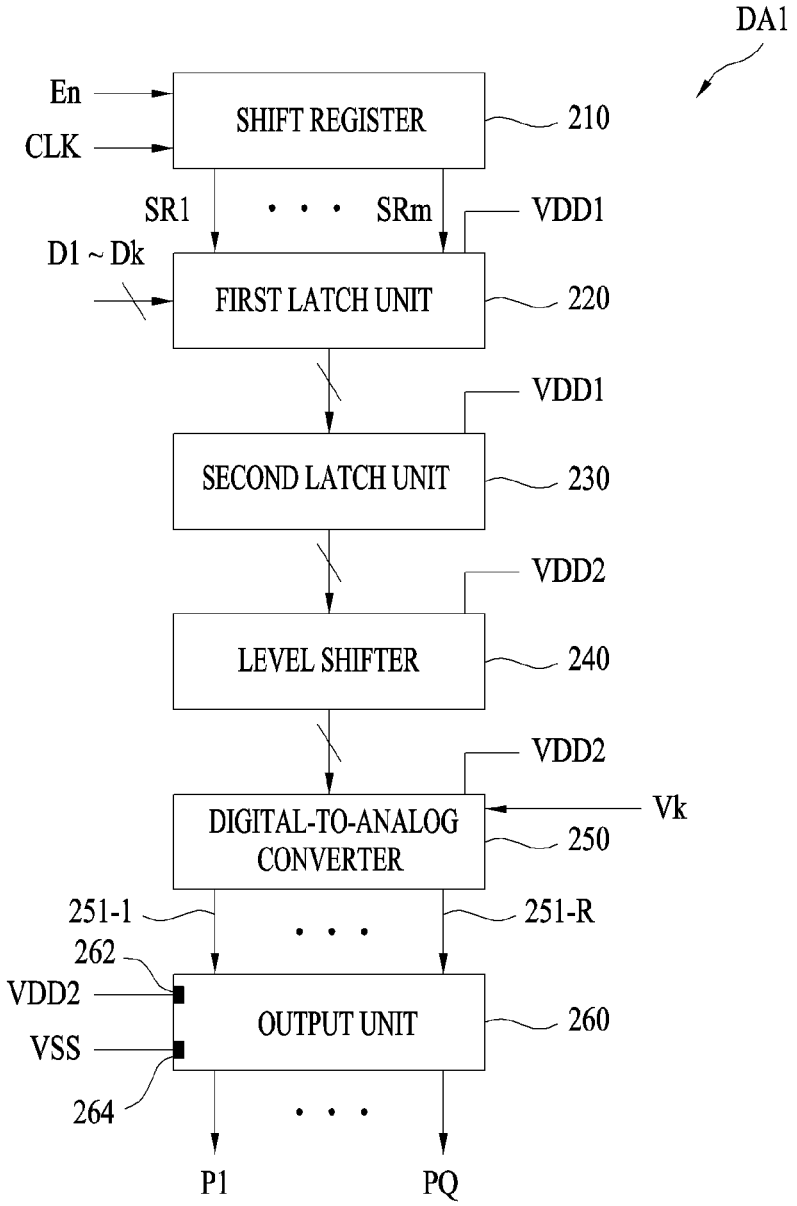
FIG. 2 is a view illustrating an exemplary configuration of a display driver illustrated in FIG. 1.

FIG. 2 is a view illustrating an exemplary configuration of the source driver DA1 illustrated in FIG. 1.

The respective source drivers DA1 to DAn (n being a natural number greater than 1) illustrated in FIG. 1 may have the same configuration. FIG. 2 illustrates a first source driver DA1, and a redundant description of the other source drivers DA2 to DAn is omitted.

Referring to FIG. 2, the source driver DA1 includes a shift register 210, a first latch unit 220, a second latch unit 230, a level shifter unit 240, a digital-to-analog converter 250, and an output unit 260.

The shift register 210 generates shift signals SR1 to SRm (m being a natural number greater than 1) in response to an enable signal En and a clock signal CLK. The shift register 210 is configured to control sequential storage timing of data (for example, digital image data, such as luminance and/or chrominance data) in the first latch unit 220 in response to the enable signal En and the clock signal CLK.

For example, the shift register 210 may receive a horizontal start signal from the timing controller 112 and shift the received horizontal start signal in response to the clock signal CLK, thereby generating the shift signals SR1 to SRm (m being a natural number greater than 1). Here, the horizontal start signal may be combined with a start pulse.

The first latch unit 220 stores data D1 to Dk (k being a natural number greater than 1) received from the timing controller 112 in response to the shift signals SR1 to SRm (m being a natural number greater than 1) generated by the shift register 210. The first latch unit 220 may include a plurality of first latches (not illustrated) that store the data D1 to Dk (k being a natural number greater than 1).

The second latch unit 230 may store data output from the first latch unit 220 and include a plurality of second latches. For example, the second latch unit 230 may store data output from the first latch unit 220 on a per horizontal line period basis.

The level shifter unit 240 converts the voltage level of the data from the second latch unit 230. For example, the level shifter unit 240 may convert a first voltage level of the data from the second latch unit 230 to a second voltage level.

For example, an operating voltage VDD2 of the level shifter unit 240 may be greater than an operating voltage VDD1 of the first latch unit 220 and the second latch unit 230. As a result, data from the second latch unit 230 having a value of VDD1 may have a value of VDD2 when output by the level shifter unit 240.

In some embodiments, the level shifter unit 240 may include a plurality of level shifters, and the number of the level shifters may be equal to the number of first latches (e.g., in the first latch unit 220) and/or the number of second latches (e.g., in the second latch unit 230).

The digital-to-analog converter 250 converts data output from the level shifter unit 240 (i.e., digital data) into an analog signal.

For example, the digital-to-analog converter 250 may convert image data from the level shifter unit 240 into an analog signal based on tone voltages Vk generated by a tone voltage generator (not illustrated).

In one embodiment, the tone voltage generator (not illustrated) may be implemented as a plurality of resistors connected in series between a first voltage source (e.g., VDD2) and a second voltage source (e.g., VSS) that generate tone voltages Vk that divide the difference between the first and second voltages into a plurality of steps (for example, 256 steps).

The output unit 260 amplifies and/or buffers an analog signal from the digital-to-analog converter 250 (buffering) and outputs the amplified (buffered) analog signal.

Figure 3:
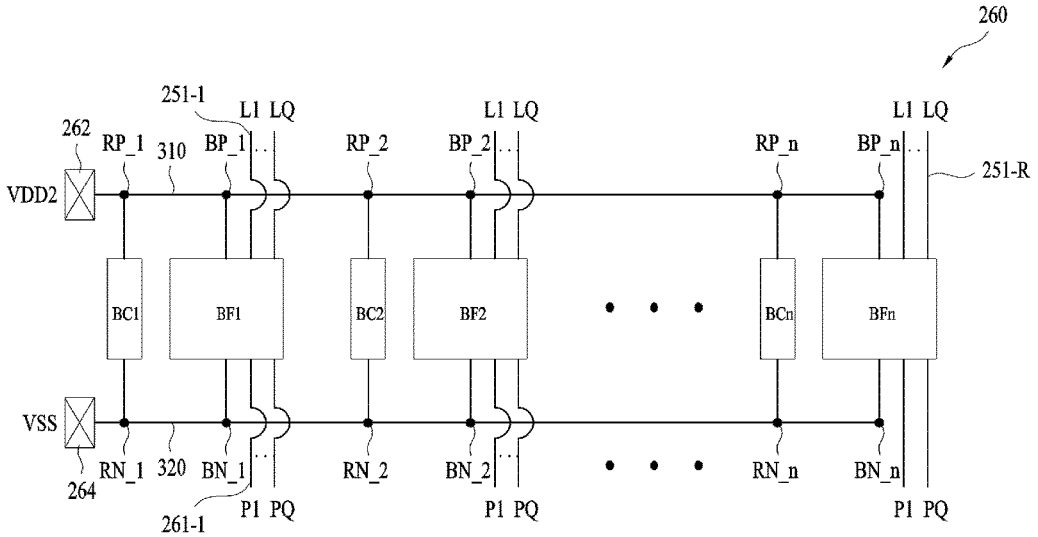
FIG. 3 is a view illustrating an exemplary configuration of an output unit illustrated in FIG. 2.

FIG. 3 is a view illustrating an exemplary configuration of the output unit 260 illustrated in FIG. 2.

Referring to FIG. 3, the output unit 260 may include a first input pad 262, a second input pad 264, a first wiring line 310, a second wiring line 320, a plurality of output buffer units BF1 to BFn (n being a natural number greater than 1), and a plurality of bias controllers BC1 to BCn (n being a natural number greater than 1).

The first input pad 262 and the second input pad 264 are electrically connected to the first wiring lines 22 on the liquid crystal panel 20.

A first supply voltage VDD2 may be supplied to the first input pad 262 from the power supply 114, and a second supply voltage VSS may be supplied to the second input pad 264 from the power supply 114.

The first supply voltage VDD2 and the second supply voltage VSS may be operating voltages for driving signals in and/or from the output unit 260.

The first wiring line 310 is electrically connected to the first input pad 262, and the second wiring line 320 is electrically connected to the second input pad 264.

The respective output buffer units BF1 to BFn (n being a natural number greater than 1) amplify and/or buffer analog signals L1 to LQ (Q being a natural number greater than 1) from the digital-to-analog converter 250, and output the amplified or buffered signals P1 to PQ (Q being a natural number greater than 1).

The respective output buffer units BF1 to BFn (n being a natural number greater than 1) may receive the operating voltages VDD2 and VSS from the first wiring line 310 and the second wiring line 320.

For example, the respective output buffer units BF1 to BFn (n being a natural number greater than 1) may be electrically connected to the first wiring line 310 and the second wiring line 320, and may receive the first supply voltage VDD2 from the first wiring line 310 and the second supply voltage VSS from the second wiring line 320.

Nodes where the respective output buffer units BF1 to BFn (n being a natural number greater than 1) are electrically connected to the first wiring line 310 are referred to as first nodes BP_1 to BP_n (n being a natural number greater than 1). Nodes where the respective output buffer units BF1 to BFn (n being a natural number greater than 1) are electrically connected to the second wiring line 320 are referred to as second nodes BN_1 to BN_n (n being a natural number greater than 1).

Sections of the first wiring line 310 that connect the first input pad 262 and the respective output buffer units BF1 to BFn (n being a natural number greater than 1) to each other may have different lengths.

In addition, the lengths or distances between the first input pad 262 and the respective first nodes BP_1 to BP_n (n being a natural number greater than 1) along the first wiring line 310 may be different. Here, a "wiring line length" may be the length of the first wiring line 310 between the first input pad 262 and one of the first nodes BP_1 to BP_n (n being a natural number greater than 1).

Similarly, sections of the second wiring line 320 that connect the second input pad 264 and the respective output buffer units BF1 to BFn (n being a natural number greater than 1) may have different lengths.

Also, the lengths or distances between the second input pad 264 and the respective second nodes BN_1 to BN_n (n being a natural number greater than 1) along the second wiring line 320 may be different. A "wiring line length" may also be the length of the second wiring line 320 between the second input pad 264 and one of the second nodes BN_1 to BN_n (n being a natural number greater than 1).

Each of the bias controllers BC1 to BCn (n being a natural number greater than 1) may receive the first supply voltage VDD2 and the second supply voltage VSS from the first wiring line 310 and the second wiring line 320, and may supply, as bias voltages, the first supply voltage VDD2 and the second supply voltage VSS to a corresponding one of the output buffer units BF1 to BFn (n being a natural number greater than 1). The bias voltages provided to the output buffer units BF1 to BFn may also be based on the received first supply voltage VDD2 and the received second supply voltage VSS.

Each of the bias controllers BC1 to BCn (n being a natural number greater than 1) may control a Direct Current (DC) bias voltage supplied to a corresponding one of the output buffer units BF1 to BFn (n being a natural number greater than 1) that the bias controllers BC1 to BCn receive from the first wiring line 310 and the second wiring line 320. The DC bias voltage supplied to the output buffer units BF1 to BFn may also be based on the first supply voltage VDD2 and the second supply voltage VSS received from the first and second wiring lines 310 and 320. Each of the bias controllers BC1 to BCn (n being a natural number greater than 1) may control a DC bias voltage to be supplied to a corresponding one of the output buffer units BF1 to BFn (n being a natural number greater than 1) independently of the other bias controllers.

Nodes where the respective bias controllers BC1 to BCn (n being a natural number greater than 1) are electrically connected to the first wiring line 310 are referred to as third nodes RP_1 to RP_n (n being a natural number greater than 1), and nodes where the respective bias controllers BC1 to BCn (n being a natural number greater than 1) are electrically connected to the second wiring line 320 are referred to as fourth nodes RN_1 to RN_n (n being a natural number greater than 1).

Each of the third nodes RP_1 to RP_n (n being a natural number greater than 1) may be located next to a corresponding one of the first nodes BP_1 to BP_n (n being a natural number greater than 1), and each of the fourth nodes RN_1 to RN_n (n being a natural number greater than 1) may be located next to a corresponding one of the second nodes BN_1 to BN_n (n being a natural number greater than 1).

For example, each of the bias controllers BC1 to BCn (n being a natural number greater than 1) may control a DC bias voltage to be supplied to output buffers included in a corresponding one of the output buffer units BF1 to BFn (n being a natural number greater than 1) based on the first supply voltage VDD2 and the second supply voltage VSS at, on or supplied to the third nodes and the fourth nodes.

Each of the respective output buffer units BF1 to BFn (n being a natural number greater than 1) may have the same configuration as the other output buffer units BF1 to BFn, and the respective bias controllers BC1 to BCn (n being a natural number greater than 1) may have the same configuration as the other bias controllers BC1 to BCn.

Figure 4:
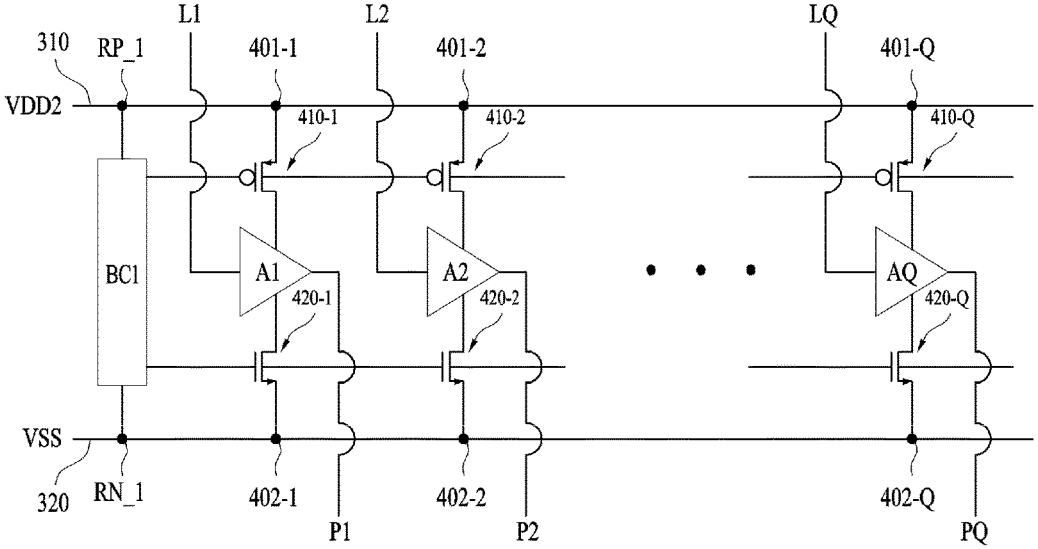
FIG. 4 is a view illustrating an exemplary configuration of a first output buffer unit and a first bias controller illustrated in FIG. 3.

FIG. 4 is a view illustrating an exemplary configuration of a first output buffer unit BF1 and a first bias controller BC1 illustrated in FIG. 3.

Referring to FIG. 4, the first output buffer unit BF1 includes a plurality of output buffers A1 to AQ (Q being a natural number greater than 1), first bias transistors 410-1 to 410-Q (Q being a natural number greater than 1), and second bias transistors 420-1 to 420-Q (Q being a natural number greater than 1).

The output buffers A1 to AQ (Q being a natural number greater than 1) buffer the analog signals L1 to LQ (Q being a natural number greater than 1) and output buffered signals P1 to PQ (Q being a natural number greater than 1).

Each of the output buffers A1 to AQ may receive a first DC bias voltage VDD2 from a corresponding node 401-1 to 401-Q (Q being a natural number greater than 1). The nodes 401-1 to 401-Q are at different positions or locations alone the first wiring line 310.

In addition, each of the output buffers A1 to AQ may receive a second DC bias voltage VSS from a corresponding node 402-1 to 402-Q (Q being a natural number greater than 1). The nodes 402-1 to 402-Q are at different positions or locations along the second wiring line 320.

A first bias controller BC1 may control the bias voltages VDD2 and VSS provided to each of the output buffers A1 to AQ in a corresponding output buffer unit BF1. The bias voltages VDD2 and VSS to each output buffer A1 to AQ are from a corresponding one of the different positions of nodes 401-1 to 401-Q along the first wiring line 310 or 402-1 to 402-Q along the second wiring line 320.

Each of the first bias transistors 410-1 to 410-Q (Q being a natural number greater than 1) may include a first source (e.g., a "bias source") and a first drain (e.g., a "bias drain") connected between a corresponding one of the output buffers A1 to AQ (Q being a natural number greater than 1) and the first wiring line 310, and a first gate (e.g., a "bias gate") that is controlled by the first bias controller BC1.

Each of the second bias transistors 420-1 to 420-Q (Q being a natural number greater than 1) may include a second (e.g., bias) source and a second (e.g., bias) drain connected between a corresponding one of the output buffers A1 to AQ (Q being a natural number greater than 1) and the second wiring line 320, and a second (e.g., bias) gate that is controlled by the first bias controller BC1.

For example, each of the first bias transistors 410-1 to 410-Q (Q being a natural number greater than 1) may be a PMOS transistor, and may include a first source connected to the first wiring line 310, a first drain connected to a corresponding output buffer, and a first gate.

Nodes where the first sources of the respective first bias transistors 410-1 to 410-Q (Q being a natural number greater than 1) are connected to the first wiring line 310 are referred to as first bias nodes 401-1 to 401-Q (Q being a natural number greater than 1).

In addition, for example, each of the second bias transistors 420-1 to 420-Q (Q being a natural number greater than 1) may be an NMOS transistor, and may include a second source connected to the second wiring line 320, a second drain connected to a corresponding output buffer, and a second gate.

Nodes where the second sources of the respective second bias transistors 420-1 to 420-Q (Q being a natural number greater than 1) are connected to the second wiring line 320 are referred to as second bias nodes 402-1 to 402-Q (Q being a natural number greater than 1).

The first bias controller BC1 may control the first supply voltage VDD2 from the first bias nodes 401-1 to 401-Q of the first wiring line 310 and the second supply voltage VSS from the second bias nodes 402-1 to 402-Q of the second wiring line 320. The first and second supply voltages VDD2 and VSS are provided as DC bias voltages to the output buffers A1 to A1.

In the embodiment of FIG. 4, the first bias controller BC1 may commonly control the first bias gates of the first bias transistors 410-1 to 410-Q (Q being a natural number greater than 1) and commonly control the second bias gates of the second bias transistors 420-1 to 420-Q (Q being a natural number greater than 1).

Figure 5:
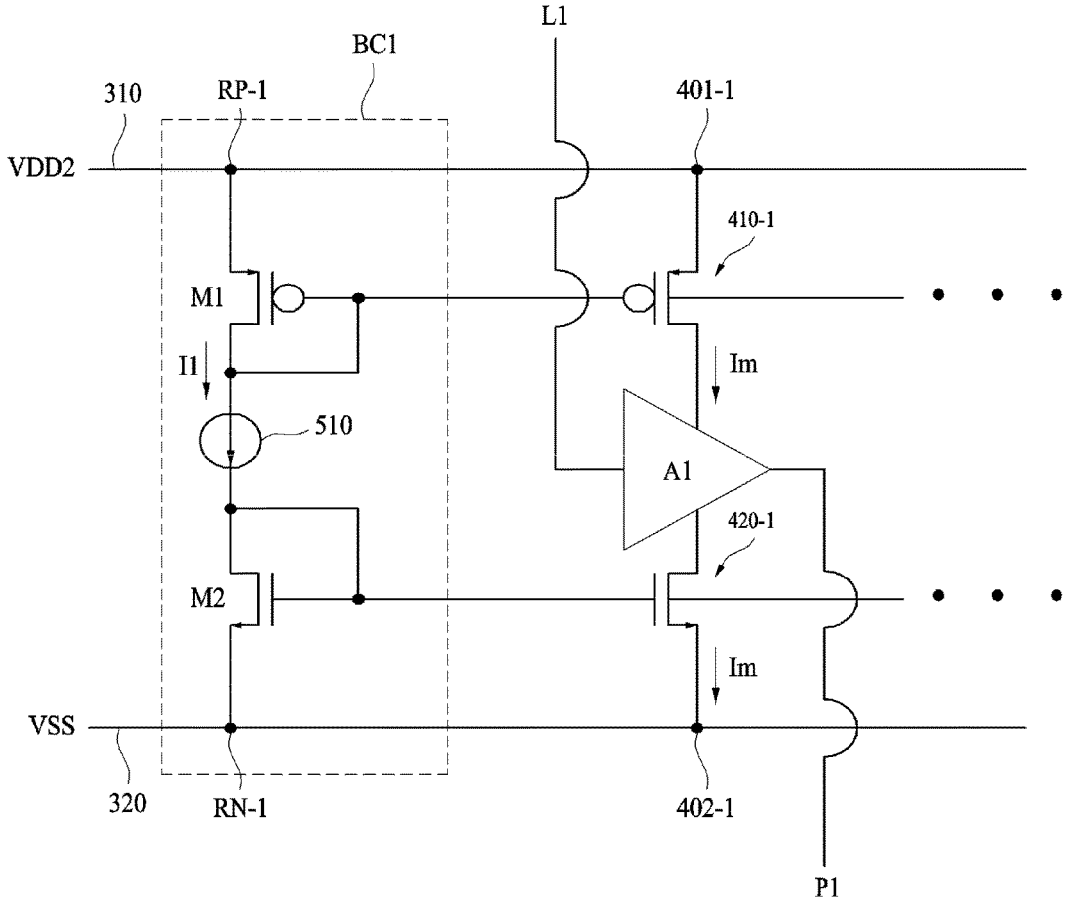
FIG. 5 is a view illustrating an embodiment of the first bias controller illustrated in FIG. 4.

FIG. 5 is a view illustrating an embodiment of the first bias controller BC1 illustrated in FIG. 4.

Referring to FIG. 5, the first bias controller BC1 may mirror or reproduce the current I1 between the third node RP_1 and the fourth node RN_1, and allow the mirrored current Im to flow between the first output buffer A1 and the first node 401-1 and between the first output buffer A1 and the second node 401-2.

The first bias controller BC1 may include a first transistor M1, a reference current supply unit 510, and a second transistor M2.

The first transistor M1 may include a first source connected to the first wiring line 310, a first gate connected to the first gates of the first bias transistors 410-1 to 410-Q, and a first drain connected to the first gate of the first transistor M1.

The second transistor M2 may include a second source connected to the second wiring line 320, a second gate connected to the second gates of the second bias transistors 420-1 to 420-Q, and a second drain connected to the second gate of the second transistor M2.

The reference current supply unit 510 may be connected between the first drain of the first transistor M1 and the second drain of the second transistor M2, and generate a reference current I1. Thus, the reference current I1 may flow to the first transistor M1 and the second transistor M2.

The first transistor M1 and the first bias transistors 410-1 to 410-Q (Q being a natural number greater than 1) may form first current mirrors, and the second transistor M2 and the second bias transistors 420-1 to 420-Q (Q being a natural number greater than 1) may form second current mirrors.

Thus, the reference current I1 flowing to the first transistor M1 may be mirrored to each of the first bias transistors 410-1 to 410-Q (Q being a natural number greater than 1). In addition, the reference current I1 flowing to the second transistor M2 may be mirrored to each of the second bias transistors 420-1 to 420-Q (Q being a natural number greater than 1).

The output buffers A1 to AQ may comprise a differential amplifier, and the current Im mirrored to the first and second bias transistors 410-1 to 410-Q and 420-1 to 420-Q may be a tail current flowing to tails of the output buffers A1 to AQ.

In the embodiments of FIGS. 3-5, the wiring distance of each of the bias controllers BC1 to BCn (n being a natural number greater than 1) from the first and second input pads 262 and 264 may be shorter than a wiring distance of a corresponding one of the output buffer units BF1 to BFn (n being a natural number greater than 1) from the first and second input pads 262 and 264.

Figure 6:
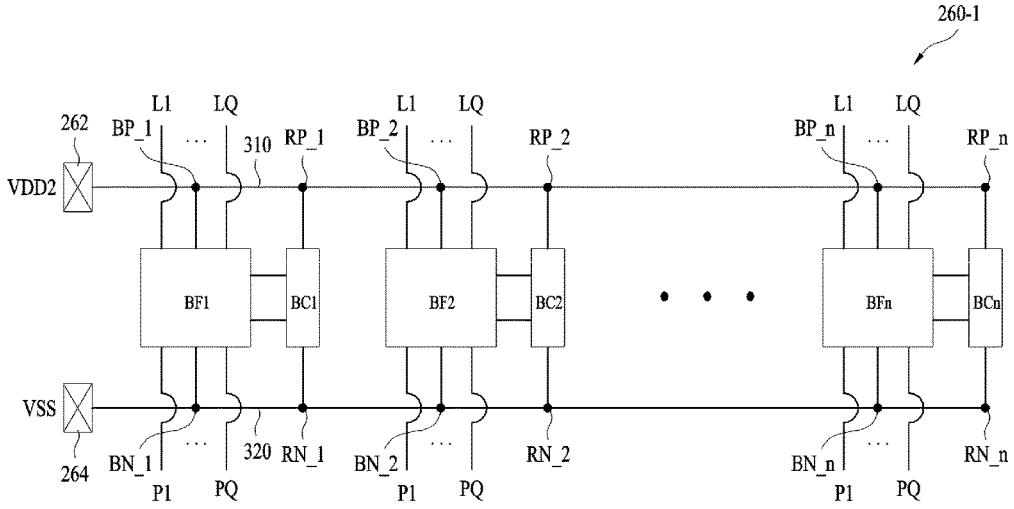
FIG. 6 is a view illustrating an exemplary configuration of an output unit according to one or more other embodiments of the invention.

FIG. 6 is a view illustrating an exemplary configuration of an output unit 260-1 according to one or more other embodiments of the present invention. The same reference numerals as those in FIG. 3 designate the same components, and a description related to the same components is provided only in brief or is omitted.

The embodiment(s) of FIG. 6 differ from the embodiment (s) of FIG. 3 in terms of the positions of the bias controllers BC1 to BCn (n being a natural number greater than 1) (e.g., relative to output buffer units BF1 to BFn).

Referring to FIG. 6, the wiring distance of each of the bias controllers BC1 to BCn (n being a natural number greater than 1) from the first and second input pads 262 and 264 may be greater than the wiring distance of a corresponding one of the output buffer units BF1 to BFn (n being a natural number greater than 1) from the first and second input pads 262 and 264.

Figure 7:
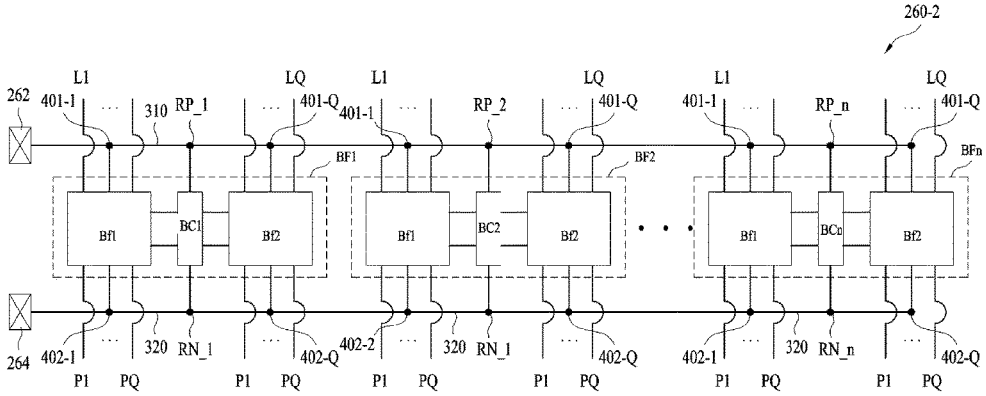
FIG. 7 is a view illustrating an exemplary configuration of an output unit according to one or more further embodiments of the invention.

FIG. 7 is a view illustrating an exemplary configuration of an output unit 260-2 according to a further embodiment. The same reference numerals as those in FIGS. 3 and 6 designate the same or substantially the same components, and a description related to the same or substantially the same components is provided only in brief or is omitted.

The embodiment of FIG. 7 differs from the embodiments of FIG. 3 and FIG. 6 in terms of positions of the bias controllers BC1 to BCn (n being a natural number greater than 1). Alternatively, the embodiment of FIG. 7 may differ from the embodiments of FIG. 3 and FIG. 6 in terms of the ratio of bias controllers to output buffer units and/or output buffers.

Referring to FIG. 7, third and fourth nodes RP_1 to RP_n and RN_1 to RN_n, where the respective bias controllers BC1 to BCn (n being a natural number greater than 1) are respectively connected to the first and second wiring lines 310 and 320, may be located between subsets of the first and second bias nodes 401-1 to 401-Q and 402-1 to 402-Q, where the output buffers A1 to AQ in one of the output buffer units BF1 to BFn are connected to the first and second wiring lines 310 and 320.

For example, the third and fourth nodes (e.g., RP_1 and RN_1) of a bias controller (e.g., BC1) may be located between two neighboring or adjacent ones of the first bias nodes 401-1 to 401-Q and of the second bias nodes 402-1 to 402-Q. In such a case, when Q is an even number of at least four, the third node RP_1 of the bias controller BC1 may be located between the first bias node 401−(Q/2) and the first bias node 401−([Q/2 ]+1), and the fourth node RN_1 of the bias controller BC1 may be located between the second bias node 402−(Q/2) to 402−([Q/2]+1).

In addition, or alternatively, each of the first and second bias nodes 401-1 to 401-Q and 402-1 to 402-Q of the output buffer unit BF1 may be horizontally symmetrical with reference to the corresponding third and fourth nodes RP_1 to RP_n and RN_1 to RN_n of the corresponding bias controller BC1 to BC_n. For example, when Q=8, four output buffers are included in the first subset of output buffers Bf1, and four output buffers are included in the second subset of output buffers Bf2. In a further alternative, each of the subsets of output buffers Bf1 and Bf2 may be replaced with a complete output buffer unit (e.g., BF1 and BF2), thereby reducing the number of bias controllers in the output unit, but obtaining and/or providing the same or substantially the same effect(s) and/or benefit(s). Thus, the ratio of bias controllers to output buffer units may be, for example, from 1:2 to 1:(Q/2). However, each output unit (e.g., 260 in FIG. 2) should have at least 2 bias controllers, and more preferably, has Q/2 or Q bias controllers.

In other embodiments, the arrangements of the bias controllers illustrated in FIGS. 3, 6 and 7 may be mixed or combined with one another. For example, some of the bias controllers may have the arrangement of the bias controllers illustrated in FIG. 3, some others may have the arrangement of the bias controllers illustrated in FIG. 6, and the others may have the arrangement of the bias controllers illustrated in FIG. 7.

Figure 8:
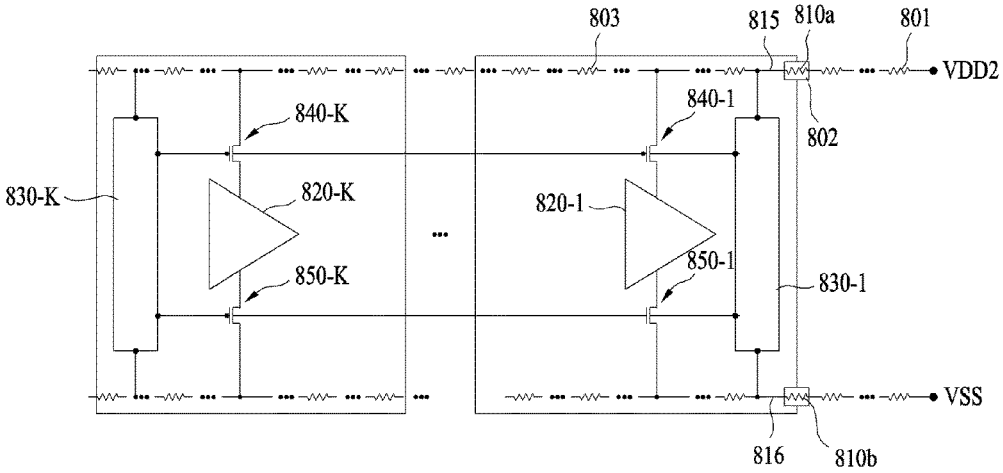
FIG. 8 is a view illustrating an exemplary configuration of an output unit including output buffer units that are controlled subordinately to one another.

FIG. 8 is a diagram illustrating an exemplary configuration of an output unit including output buffer units that are controlled subordinately to one another.

Referring to FIG. 8, a voltage supplied to output buffers 820-1 to 820-K of a display driver (e.g., source driver) is affected by ITO wiring resistances 801 of a liquid crystal panel, resistances 802 of input pads 810*a* and 810*b* of the display driver, and resistances 803 of first and second wiring lines 815 and 816 of the display driver.

For example, since resistance increases with increasing wiring distance from the input pads 810*a* and 810*b*, supply voltages supplied to the output buffers 820-1 to 820-K having different wiring distances from the input pads 810*a* and 810*b* may be affected by different voltage drops due to the different wiring resistances.

Outputs of the bias controllers that control operating or bias voltages of the output buffers 820-1 to 820-K are commonly short-circuited to the gates of bias transistors 840-1 to 840-K and 850-1 to 850-K, regardless of the positions or locations of the bias controllers. As such, the output buffers 820-1 to 820-K may be affected by different voltage drops due to the different resistances along the wiring lines 815 and 816. As a result, the output buffers 820-1 to 820-K may thereby operate at different supply voltages, depending on the position or location of the output buffer 820-1 to 820-K.

In addition, the voltage drop due to the length-dependent resistance of the wiring lines 815 and 816 may cause different voltages between the gates and the sources of the bias transistors 840-1 to 840-K and 850-1 to 850-K. This may result in deviations in the amount of bias current supplied to the various output buffers 820-1 to 820-K. Consequently, deviations in the slew rate of output signals from the output buffers 820-1 to 820-K may result. The deviation in the slew rate of the output signals from the output buffers 820-1 to 820-K may result in abnormal resolution of the display apparatus.

Embodiments of the invention may group a plurality of output buffers into a plurality of output buffer groups and include an independent bias controller to provide a common bias voltage to the output buffers in each group, thereby reducing deviations in the slew rate of the output buffers.

Figure 9:
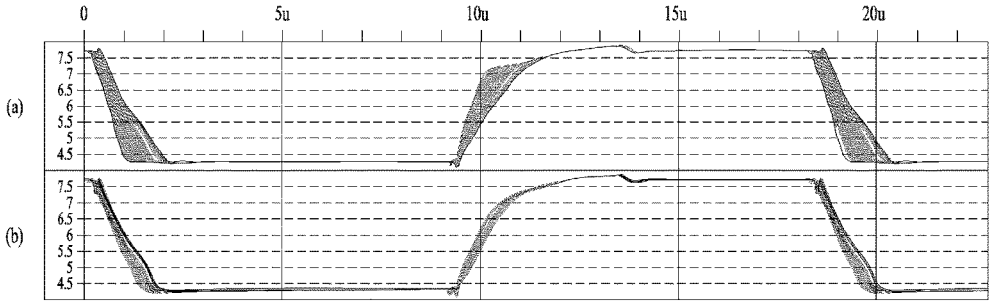
FIG. 9 is a graph illustrating output waveforms of the output unit illustrated in FIG. 8 and an exemplary output unit according to an embodiment of the invention.

FIG. 9 includes two graphs showing outputs of the output unit illustrated in FIG. 8 and an output unit according to an embodiment of the invention. Graph (a) in FIG. 9 illustrates outputs from the output unit illustrated in FIG. 8, and graph (b) in FIG. 9 illustrates outputs from the output unit according to an embodiment of the invention.

Referring to FIG. 9, it can be appreciated that the slew rate of the output signals from the output unit of an embodiment of the invention (graph (b)) is smaller than the slew rate of the output signals from the output unit of FIG. 8 (graph (a)).

Figure 10:
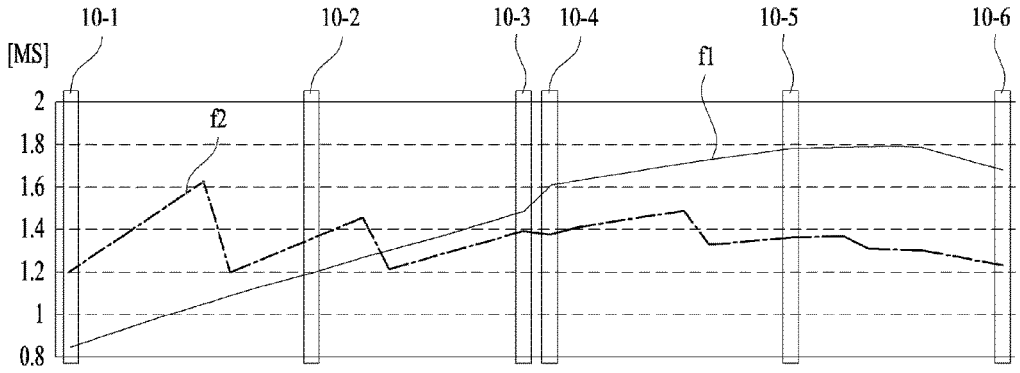
FIG. 10 is a graph illustrating the slew rate of the output unit illustrated in FIG. 8 and the slew rate of the output unit according to an embodiment of the invention.

FIG. 10 illustrates slew rates of output buffers in the output unit illustrated in FIG. 8 and slew rates of output buffers in the output unit according to an embodiment of the invention. The x-axis represents a position of one or both of the wiring lines providing a supply voltage to the output unit. For example, the position becomes distant from an input pad from the left side to the right side of the x-axis. Reference numerals 10-1 to 10-6 represent positions of bias controllers along the wiring line(s), f1 represents the slew rates of output buffers in the output unit illustrated in FIG.

8, and f2 represents the slew rates of output buffers in the output unit according to an embodiment of the invention.

Referring to FIG. 10, it can be appreciated that deviations from an average slew rate in the line f2 are smaller than deviations from the average slew rate in the line f1. The maximum deviation in the slew rate in the line f2 is reduced by 0.53 μs as compared to the maximum deviation in the slew rate in the line f1.

As is apparent from the above description, embodiments of the present invention may reduce deviations in the slew rate of output signals from output buffers (e.g., in an output unit of a display driver).

Features, structures, effects, and the like as described above in the various embodiments are included in at least one embodiment of the present invention and should not be limited to only one embodiment. In addition, the features, structures, effects, and the like described in the respective embodiments may be combined or modified even with respect to the other embodiments by those skilled in the art. Accordingly, contents related to these combinations and modifications should be construed as within the scope of the present invention.

What is claimed is:

1. A display driver comprising:

an input pad configured to receive a supply voltage;

a wiring line connected to the input pad and configured to supply the supply voltage, the wiring line having a plurality of different positions or locations;

a digital-to-analog converter configured to convert digital signals to analog signals;

a plurality of output buffer units configured to receive a bias voltage and buffer the analog signals; and a plurality of bias controllers connected to the positions or locations of the wiring line, wherein each of the bias controllers independently controls the bias voltage of one or more of the output buffer units from the supply voltage supplied by the wiring line, wherein a first one of the output buffer units and the wiring line are connected at a first node, a first bias controller corresponding to the first output buffer unit and the first wiring line are connected at a second node, and the first and second nodes are adjacent to each other.

2. The display driver according to claim 1, wherein a wiring distance of each of the bias controllers from the input pad is shorter than a wiring distance of a corresponding one of the output buffer units from the input pad.

3. The display driver according to claim 1, wherein a wiring distance of each of the bias controllers from the input pad is longer than a wiring distance of a corresponding one of the output buffer units from the input pad.

4. The display driver according to claim 1, wherein each of the output buffer units includes a plurality of output buffers connected to the wiring line.

5. The display driver according to claim 4, wherein each of the plurality of output buffers receives the bias voltage, and each of the bias controllers controls the bias voltage to each of the output buffers in a corresponding one of the output buffer units.

6. The display driver according to claim 4, wherein each of the output buffer units further includes a plurality of bias transistors, and each of the bias transistors includes (i) a source and a drain connected between a corresponding one of the output buffers and the wiring line and (ii) a gate configured to be controlled by a corresponding one of the bias controllers.

7. The display driver according to claim 6, wherein each of the bias controllers includes a first transistor including a first source connected to the wiring line, a first gate connected to the gates of the bias transistors in a corresponding one of the output buffer units, and a first drain connected to the first gate.

8. The display driver according to claim 7, wherein each of the bias controllers further includes a reference current supply unit connected to the drain of the first transistor.

9. The display driver according to claim 8, wherein each of the bias transistors and the first transistor form a current mirror.

10. The display driver according to claim 4, wherein each of the bias controllers provides the supply voltage as the bias voltage through nodes where the output buffers in a corresponding one of the output buffer units and the wiring line are connected.

11. The display driver according to claim 4, wherein each of the bias controllers and the wiring line are connected at a first node, the output buffers in a corresponding one of the output buffer units and the wiring line are connected at second nodes, and each of the first nodes is located between subsets of each of the corresponding second nodes.

12. The display driver according to claim 11, wherein the second nodes are symmetrical with respect to the first node.

13. The display driver according to claim 1, further comprising:

a latch unit configured to store data; and a level shifter configured to convert a voltage level of the data from the latch unit and to provide the digital-to-analog converter with the data having the converted voltage level.

14. A display driver comprising:

a first input pad configured to receive a first supply voltage;

a second input pad configured to receive a second supply voltage;

a first wiring line connected to the first input pad;

a second wiring line connected to the second input pad;

a digital-to-analog converter configured to convert digital signals to analog signals;

a plurality of output buffer units configured to buffer the analog signals; and a plurality of bias controllers connected between the first wiring line and the second wiring line, wherein each of the output buffer units includes a plurality of output buffers, each of the output buffers is connected to the first wiring line at a first node and to the second wiring line at a second node, each of the first and second nodes is at a different position or location along the first and second wiring lines, respectively, and each of the output buffer units includes (i) first bias transistors connected between the output buffers and the first nodes and (ii) second bias transistors connected between the output buffers and the second nodes, and each of the bias controllers includes (i) a first transistor including a first source connected to the first wiring line, a first gate connected to gates of the first bias transistors, and a first drain connected to the first gate of the first transistor and (ii) a second transistor including a second source connected to the second wiring line, a second gate connected to gates of the second bias transistors, and a second drain connected to the second gate of the second transistor, and each of the bias controllers independently controls bias voltages of the plurality of output buffers in a corresponding one of the output buffer units.

15. The display driver according to claim 14, wherein each of the bias controllers controls the bias voltages of each of the output buffers in a corresponding one of the output buffer units so as to receive a first bias voltage from a corresponding one of the first nodes and a second bias voltage from a corresponding one of the second nodes.

16. A display apparatus comprising:

a display panel including gate lines in rows, data lines in columns, and a pixel array connected to the gate lines and the data lines; and display drivers configured to drive the gate lines and/or the data lines, wherein each of the display drivers includes:

an input pad configured to receive a supply voltage;

a wiring line connected to the input pad and configured to supply the supply voltage;

a digital-to-analog converter configured to convert digital data to analog signals;

a plurality of output buffer units configured to receive a bias voltage buffer the analog signals; and a plurality of bias controllers connected to different positions of the wiring line, wherein each of the bias controllers independently controls the bias voltage to a corresponding one of the output buffer units from the supply voltage supplied by the wiring line, a first one of the output buffer units and the wiring line are connected at a first node, a first bias controller corresponding to the first output buffer unit and the first wiring line are connected at a second node, and the first and second nodes are adjacent to each other.

* * * * *